US008317033B2

(12) United States Patent
Huart

(10) Patent No.: US 8,317,033 B2
(45) Date of Patent: Nov. 27, 2012

(54) METHOD AND DEVICE FOR CONCENTRATING SUBSTANCES IN SOLID PARTICLE STATE

(75) Inventor: Pol Huart, Saint Symphorien (BE)

(73) Assignee: Genimin SPRL, Saint Symphorien (BE)

( * ) Notice: Subject to any disclaimer, the term of this patent is extended or adjusted under 35 U.S.C. 154(b) by 885 days.

(21) Appl. No.: 12/088,417

(22) PCT Filed: Sep. 27, 2006

(86) PCT No.: PCT/BE2006/000106

§ 371 (c)(1),
(2), (4) Date: Aug. 21, 2008

(87) PCT Pub. No.: WO2007/036006

PCT Pub. Date: Apr. 5, 2007

(65) Prior Publication Data

US 2009/0014365 A1 Jan. 15, 2009

(30) Foreign Application Priority Data

Sep. 27, 2005 (EP) ..... 05020997

(51) Int. Cl.
*B03B 5/22* (2006.01)

(52) U.S. Cl. ..... 209/730; 209/459; 209/460; 209/724; 209/725

(58) Field of Classification Search ..... 209/724, 209/725, 730, 734, 425, 426, 459, 460
See application file for complete search history.

(56) References Cited

U.S. PATENT DOCUMENTS 3,557,956 A * 1/1971 Braun et al. ..... 162/5
4,056,464 A * 11/1977 Cross ..... 209/425
4,071,440 A * 1/1978 Jedo et al. ..... 209/44
4,216,095 A * 8/1980 Ruff ..... 210/512.1
4,279,741 A 7/1981 Campbell et al.
4,341,352 A * 7/1982 Liller ..... 241/21
4,399,027 A * 8/1983 Miller ..... 209/164
4,574,046 A 3/1986 Sprow et al.
4,898,666 A * 2/1990 Kelsey ..... 209/425
4,997,549 A * 3/1991 Atwood ..... 209/164
4,998,986 A * 3/1991 Campbell ..... 209/44
5,114,569 A * 5/1992 Kelsey ..... 209/425
5,192,423 A * 3/1993 Duczmal et al. ..... 209/164
5,436,384 A * 7/1995 Grant et al. ..... 588/1
5,564,574 A * 10/1996 Kuryluk ..... 209/731
5,616,245 A * 4/1997 Albrecht ..... 210/371
5,938,043 A * 8/1999 Costin et al. ..... 209/425
6,244,446 B1 * 6/2001 Schmittel ..... 209/157
6,286,686 B1 * 9/2001 Kelsey et al. ..... 209/44
6,596,169 B1 * 7/2003 Rong et al. ..... 210/512.1
6,612,443 B2 * 9/2003 Kelsey et al. ..... 209/44
7,445,121 B2 * 11/2008 Mainin et al. ..... 209/365.2
7,479,231 B2 * 1/2009 Bernard ..... 210/744
7,585,665 B2 * 9/2009 Iiyama et al. ..... 435/289.1
2001/0054575 A1 * 12/2001 Kelsey et al. ..... 209/44

* cited by examiner

*Primary Examiner* — Joseph C Rodriguez

(74) *Attorney, Agent, or Firm* — Leydig, Voit & Mayer, LLP

(57) ABSTRACT

A method for concentrating a particulate matter, comprising at least two constituents of different densities, in which a slurry of particulate matter is subjected to centrifugation and to centripetal pulses in a centrifugation chamber. A dense fraction of the slurry and a light fraction of the slurry are drawn off separately from the centrifugation chamber. In order to produce the centripetal pulses, a fluid is injected into the slurry, in a direction oblique or tangential to the direction of centrifugation. The fluid is injected substantially continuously into the slurry.

24 Claims, 8 Drawing Sheets

METHOD AND DEVICE FOR CONCENTRATING SUBSTANCES IN SOLID PARTICLE STATE

FIELD OF THE INVENTION

The invention relates to the concentrating of materials in solid particle state, comprising several organic and/or inorganic constituents of different densities.

The invention relates more particularly to an improved method for the densimetric concentration of ultrafine particles of such materials, according to the principle of jigging in a centrifugation chamber, and also to an apparatus for implementing this improved method.

PRIOR ART

Jigging is a well-known technique for concentrating solid materials comprising substances of different densities [for example, an ore stripped of its components (naturally for alluvial and eluvial deposits or after grinding), the cleansing of soil polluted with buckshot, or any other mixture of different materials].

Jigging involves several physical principles in order to allow the segregation of particles according to their density while preventing the phenomenon of equivalence which occurs during the freefall of these particles, where a coarse light particle has the same sedimentation speed as a fine heavy particle.

The physical principles are the following:

- the displacement of the particles during a short acceleration depends only on the density of the particles;
- the free sedimentation speed promotes the sedimentation of the coarsest of particles;
- the retarded sedimentation (the particles impede one another and collide with one another during the sedimentation) promotes the sedimentation of the finest particles. This phenomenon occurs especially at the end of sedimentation. It has a tendency to compensate for the second, which favors the coarse particles.

Jigging techniques can be divided up into two major families: jigging techniques under the action of gravity and jigging techniques by centrifugation. The techniques that use the action of gravity generally use two segregation driving forces, one of which uses the first physical principle stated above and the other of which uses the other two physical principles. However, as soon as the particle size decreases, the specific surface area increases and the surface forces (drag) become predominant with respect to the volumic forces (weight) which are in competition in the jigging phenomenon. One way to solve this problem is to centrifuge the material in order to increase the volumic forces. Centrifugal jigging techniques rarely use the first segregation driving force, since the means normally used to subject the solid particles to short accelerations are not generally satisfactory and impair the correct functioning of the jig. In document WO-90/00090, a centrifugal jigging apparatus is described, in which the two segregation driving forces are used. To this effect, in this known apparatus, a slurry of a particulate matter to be concentrated is subjected to centrifugation in a cylindrical chamber, the peripheral wall of which comprises a grid covered with a filter bed and, during the centrifugation, the filter bed is subjected to pulsed centripetal displacements which have the effect of subjecting the slurry in the chamber to isolated centripetal forces. The combined action of these isolated centripetal forces and of the permanent centrifugal force on the slurry gradually generates radial stratification of the particles of the matter in the centrifugation chamber, as a function of their respective densities, this stratification being substantially independent of the sizes of the particles or influenced very little by the latter. The dense particles collect in a peripheral zone of the slurry and the less dense particles concentrate in a central zone thereof. In the apparatus of document WO-90/00090, a series of flexible-wall cavities, fed with water, surround the abovementioned grid of the chamber. The chamber, its grid and the cavities are entrained at high speed in order to centrifuge the slurry and the flexible wall of the cavities is subjected to displacements according to a defined frequency, in order to project the water that they contain through the grid and to subject the filter bed to centripetal pulses. In this known apparatus, the pulsing transmitted to the slurry is induced by mechanical effect, the disadvantageous result of which is that the frequency of the pulses is limited because of problems of mechanical inertia. However, a very high frequency is necessary in order to cause the very short accelerations required for the segregation of very fine particles. The finer the particles are, the shorter these accelerations must be. This is because the finer these particles are, the larger the specific surface area, and the greater the drag. Under these conditions, the period of acceleration during which the drag effect can be ignored is very short. Therefore, the higher the frequency of the successive accelerations, the smaller the influence of the drag.

The known apparatus of document WO-90/00090 has the additional disadvantage of being complicated to construct. In particular, there are serious difficulties in making it leaktight. In addition, the need for a filter bed on the centrifuge grid constitutes another difficulty, particularly the practical production of a grid with an ultrafine mesh size. This results in an expensive construction and an apparatus that is difficult to run.

SUMMARY OF THE INVENTION

The invention aims to remedy the drawbacks of the known centrifugal apparatus described above.

The invention aims more particularly to provide a new and improved method for concentrating, by the centrifugal jigging technique, materials in solid particle state, comprising several organic and/or inorganic constituents of different densities.

The invention aims most especially to provide a method which makes it possible to carry out, simply and economically, rapid and effective concentration of ultrafine particles of such materials.

An objective of the invention is also to provide an apparatus for concentrating such materials by the centrifugal jigging technique, said apparatus having a simple, practical and economical design and providing, moreover, great reliability and a high operating yield.

By convention, in the rest of this specification, the expression "particulate matter" denotes a solid material in the form of particles of various sizes and shapes, comprising at least two organic and/or inorganic solid constituents. The particulate matter may, for example, comprise an ore, the constituents of which comprise minerals.

The expression "useful substance" denotes a solid or mineral component that it is sought to extract in the concentrated state from the particulate matter, and the expression "unproductive substance" denotes a solid or mineral residual component that it is sought to separate from the useful substance (s).

The term "slurry" denotes an aqueous dispersion or suspension of the abovementioned particulate matter in water or another appropriate liquid (organic or inorganic). The liquid selected should have a density below that of the particulate matter.

Consequently, the invention relates to a method for concentrating a particulate matter, comprising at least two constituents of different densities, in which a slurry of said particulate matter is subjected to centrifugation and to centripetal pulses in a centrifugation chamber, and a dense fraction of the slurry and a light fraction of the slurry are drawn off from the centrifugation chamber, the method being characterized in that, in order to produce the centripetal pulses, a fluid is injected into the slurry, in a direction which has a component tangential to the centrifugation.

In the method according to the invention, the function of the centrifugation is to subject the particles of the particulate matter to a centrifugal acceleration and, as a result, to centrifugal forces which will radially classify the particles of the particulate matter according to their respective masses. The centrifugation can be carried out by any appropriate means, for example using a rotary centrifuge. The centrifugation is carried out in a centrifugation chamber. The latter is normally a revolving chamber. It may, for example, be cylindrical, conical or frustoconical. It is not essential for the definition of the invention and will be explained below.

The speed of the centrifugation will condition the centrifugal acceleration of the slurry and, consequently, the centrifugal forces acting on the particles of the particulate matter. It is not essential for the definition of the invention. All things being otherwise equal, it will condition the productivity of the method and the precision of the cutoff between the light fraction and the dense fraction of the particulate matter. The optimum centrifugation speed will depend on various parameters, among which are the density of the or of each useful substance of the particulate matter, the densities of the unproductive substances, the particle size distribution of the particulate matter and the dimensions of the chamber used for the centrifugation. These parameters should be determined in each specific case by those skilled in the art, by means of routine laboratory tests or research department studies.

The function of the centripetal pulses is to subject the centrifuged slurry to isolated centripetal forces of short durations, comparable to impacts, according to a defined frequency.

In accordance with the invention, the centripetal pulses are obtained by objecting a fluid into the slurry subjected to the centrifugation, this fluid injection comprising a component tangential to the centrifugation.

The fluid may invariably be a gas or a liquid. It should be substantially inert with respect to the constituents of the slurry. In the case of a liquid, the latter cannot normally be a substance that dissolves the constituents of the particulate matter. It may be without distinction an organic liquid or an aqueous liquid. Liquids which are miscible with the liquid of the slurry are especially recommended. The same liquid as that of the slurry is advantageously used, water being preferred.

The fluid is injected into the slurry in the form of a localized jet, this jet having a component which is tangential to the direction of rotation of the slurry and to the peripheral wall of the centrifugation chamber. The injection may be strictly tangential to the peripheral wall of the centrifugation chamber. It is preferably oblique, so as to also have a radial component.

The injection of the fluid is preferably carried out continuously, with a substantially constant speed and/or a substantially constant flow rate. A continuous injection with a substantially constant injection speed is preferred. The tangential injection of the fluid into the slurry generates, in the latter, local centripetal pulses opposite the fluid injection zone. The particles of particulate matter in the slurry are thus subjected to tangential and centripetal isolated accelerations which superimpose on the substantially constant centrifugal acceleration. The frequency of the centripetal accelerations to which each particle of particulate matter is subjected depends on the rotational speed of the slurry in the centrifugation chamber. The combination of the centrifugal acceleration and the isolated centripetal accelerations produces a gradual stratification of the particles of the particulate matter in the slurry, according to their respective densities, the most dense particles migrating to the periphery of the slurry vortex and the less dense particles migrating in the opposite direction.

The quality of the stratification of the particulate matter particles in the slurry and, consequently, the particulate matter concentration yield, will depend on various parameters, among which are the dimensions of the centrifugation chamber, the flow rate of the slurry and the speed at which it is introduced into the centrifugation chamber, and also the flow rate and the speed of injection of the fluid into the slurry. The optimum values of these parameters will also depend on various factors, in particular on the particulate matter treated, on the respective densities of the useful substance and of the unproductive substances, on the particle size distribution of the particulate matter in the slurry and the concentration of the slurry, and also on the densities of the slurry liquid and of the injected fluid. These optimum values should consequently be determined in each specific case by those skilled in the art, by means of routine laboratory tests.

In the method according to the invention, a dense fraction of the slurry and a light fraction are drawn off. The dense fraction is normally drawn off at the periphery of the centrifuged slurry vortex, generally in a direction tangential to this vortex.

In a specific embodiment of the method according to the invention, the centrifugation chamber is cylindrical, the slurry is introduced therein with a defined speed, tangentially to the peripheral wall of the chamber, and the dense fraction is drawn off tangentially to said wall.

The term "tangentially" is intended to specify that the direction in which the slurry is introduced into the chamber and the direction in which the dense fraction is drawn off each comprise a component that is tangential to the wall of the chamber. These directions may consequently be strictly tangential or may be oblique. It is preferable for them to be strictly tangential or virtually tangential.

The dense fraction is normally drawn off downstream of the introduction of the pulp into the centrifugation chamber, the expressions "upstream" and "downstream" being defined relative to the direction of rotation of the slurry vortex in the centrifugation chamber.

In the specific embodiment which has just been described, the light fraction of the slurry can be drawn off from the centrifugation chamber axially. It is preferable for it to be drawn off tangentially to the abovementioned peripheral wall of said chamber, downstream of the drawing off of the dense fraction.

In the specific embodiment which has just been described, the tangential speed of introduction of the slurry into the chamber will condition its rotational speed in the chamber and, consequently, the centrifugal acceleration.

In this specific embodiment, the cylindrical chamber may be horizontal, oblique or vertical. The chamber is preferably substantially vertical.

In the implementation of the method according to the invention, it is necessary to evacuate from the chamber the fluid which has served to generate the centripetal pulses in the slurry. This evacuation may be carried out by any appropriate means, generally downstream of the drawing off of the light fraction.

In an advantageous embodiment of the specific embodiment which has just been described, the fluid which serves to produce the centripetal pulses is injected through the abovementioned peripheral wall of the centrifugation chamber, substantially over the entire length thereof.

In a variation of implementation of the embodiment described above, at least one additional drawing off of an additional fraction of slurry is carried out, this additional drawing off being carried out downstream of the drawing off of the dense fraction and upstream of the drawing off of the light fraction. In this variation of implementation of the invention, the content of useful substance of the additional fraction is intermediate between the respective contents of said useful substance in, firstly, the dense fraction and, secondly, the light fraction. This variation of embodiment of the invention thus produces a fractionation of the particulate matter into several fractions with different degrees of enrichment in useful substance. In the rest of this specification, the abovementioned additional drawing off will be referred to as "intermediate drawing off" and the corresponding additional fraction will be referred to as "intermediate fraction".

In the variation of implementation of the invention which has just been described, the yield from the concentration with respect to useful substance can be substantially improved by recycling the intermediate fraction into the slurry that is introduced into the centrifugation chamber.

In the method according to the invention and specific embodiments thereof, the dense fraction constitutes the useful fraction (concentrated with respect to useful substance) or a by-product (enriched in unproductive substances from the particulate matter), according to whether the density of the useful substance is higher than those of the unproductive substances or lower than the latter.

The method according to the invention is especially suitable for concentrating particulate matter with a small particle size, in particular in the form of particles of diameter less than 800 μm, generally between 1 and 500 μm, the diameter of a particle being, by definition, the diameter of a sphere having the same volume as the particle.

In a specific embodiment of the method according to the invention, which is especially suitable for such particulate matter, the centrifugation is adjusted so as to subject the slurry to a centrifugal acceleration of greater than 3000 $m/s^2$ and the injection of the fluid is adjusted such that the centripetal pulses have an acceleration substantially between 1 and 5 times the abovementioned centrifugal acceleration.

The invention also relates to an apparatus for implementing the method according to the invention, said apparatus comprising a centrifugation chamber, a device for introducing a slurry of the particulate matter into the centrifugation chamber, a device for generating centripetal pulses in the slurry in the centrifugation chamber, a device for drawing off a dense fraction of the slurry and a device for drawing off a light fraction of the slurry; in accordance with the invention, the device for generating centripetal pulses in the slurry comprises a duct which opens into the abovementioned chamber, through a peripheral wall thereof, and which communicates with a fluid injection member.

In the apparatus according to the invention, the peripheral wall of the centrifugation chamber is a wall of revolution. It may have any appropriate profile. It may, for example, be a cylindrical wall, a conical wall or a frustoconical wall. Cylindrical walls are preferred. The peripheral wall of revolution may be horizontal, vertical or oblique. The wall is preferably substantially vertical.

The device for feeding the centrifugation chamber with the slurry comprises a duct which opens into the chamber, through its peripheral wall, this duct also communicating with a member for continuous injection of the slurry. The slurry introduction duct is placed tangentially or obliquely relative to the peripheral wall. It is preferably substantially tangential with respect to this wall.

The duct for injecting the fluid which serves to generate the pulses opens out obliquely or tangentially through the peripheral wall of the centrifugation chamber. It comprises a tangential component which is preferably in the same direction as the tangential component of the duct for introducing the slurry. The fluid injection member is advantageously designed such that the injection of the fluid is continuous and at a substantially constant flow rate and/or speed.

The device for drawing off the dense fraction advantageously comprises a duct which passes through the peripheral wall of the centrifugation chamber and which is oriented so as to have a tangential component in the same direction as the tangential component of the duct for introducing the slurry.

The device for drawing off the light fraction preferably comprises a duct which passes through the peripheral wall of the centrifugation chamber, downstream of the duct for drawing off the dense fraction, and which is oriented so as to have a tangential component in the same direction as the tangential component of the duct for introducing the slurry.

In a specific embodiment of the apparatus according to the invention, the centrifugation chamber comprises at least one additional device for drawing off a fraction of the slurry, said additional drawing-off device comprising a duct which passes through the peripheral wall of the centrifugation chamber, between the ducts for drawing off the dense fraction and the light fraction. The additional drawing-off duct is advantageously similar to the ducts for drawing off the dense and light fractions. As a variation, the additional drawing-off duct may be connected to the device for feeding said chamber in order to recycle thereto the fraction drawn off.

In an advantageous embodiment of the apparatus according to the invention, the duct for injecting the fluid intended to generate the pulses comprises a slit which is made through the peripheral wall of the centrifugation chamber, over a substantial length of said wall. The expression "over a substantial length of the wall of the chamber" is intended to mean a length greater than half the total length of the chamber, generally at least equal to 75% (preferably 80%) of the total length of the chamber. By definition, the total length of the chamber is the length of the chamber, from the slurry feed device to the device for drawing off the light fraction.

The apparatus according to the invention normally comprises a device for evacuating the fluid that has served to generate centripetal pulses in the slurry. This evacuation device normally comprises a duct which opens out through the peripheral wall of the centrifugation chamber, downstream of the device for drawing off the light fraction. As a variation, it may comprise a duct which passes axially through the downstream end of the centrifugation chamber.

The method and the apparatus according to the invention have various applications. They in particular have an application for concentrating soils or ores occurring naturally in the granular or pulverulent state, such as, for example, alluvial products. The method and the apparatus according to the invention are especially suitable for the enrichment processing of ultrafine ores, in particular for recovering fine residues from milling and for processing minerals recovered from alluvial and eluvial deposits or after milling. The method and the apparatus according to the invention have a most particular application for concentrating gold ores, diamond ores and any other valuable mineral, of different density to the environment (cassiterite, wolframite, coltan, tourmaline, garnet, chrysoberyl, spinel, zircon, rhodonite, ruby, sapphire, etc.). The method and the apparatus according to the invention also have an application for treating polluted soils, for example for treating sludge from dredging watercourses, polluted with heavy metals, cleansing soils polluted with buckshot, cleansing industrial areas polluted with organic and/or inorganic solid materials.

BRIEF DESCRIPTION OF THE FIGURES

Particularities and details of the invention will become apparent over the course of the following description of the attached figures, which represent specific embodiments of the invention.

In these figures, the same reference notations generally denote the same elements.

The figures are not drawn to scale.

DETAILED DESCRIPTION OF SPECIFIC EMBODIMENTS

Figure 1:
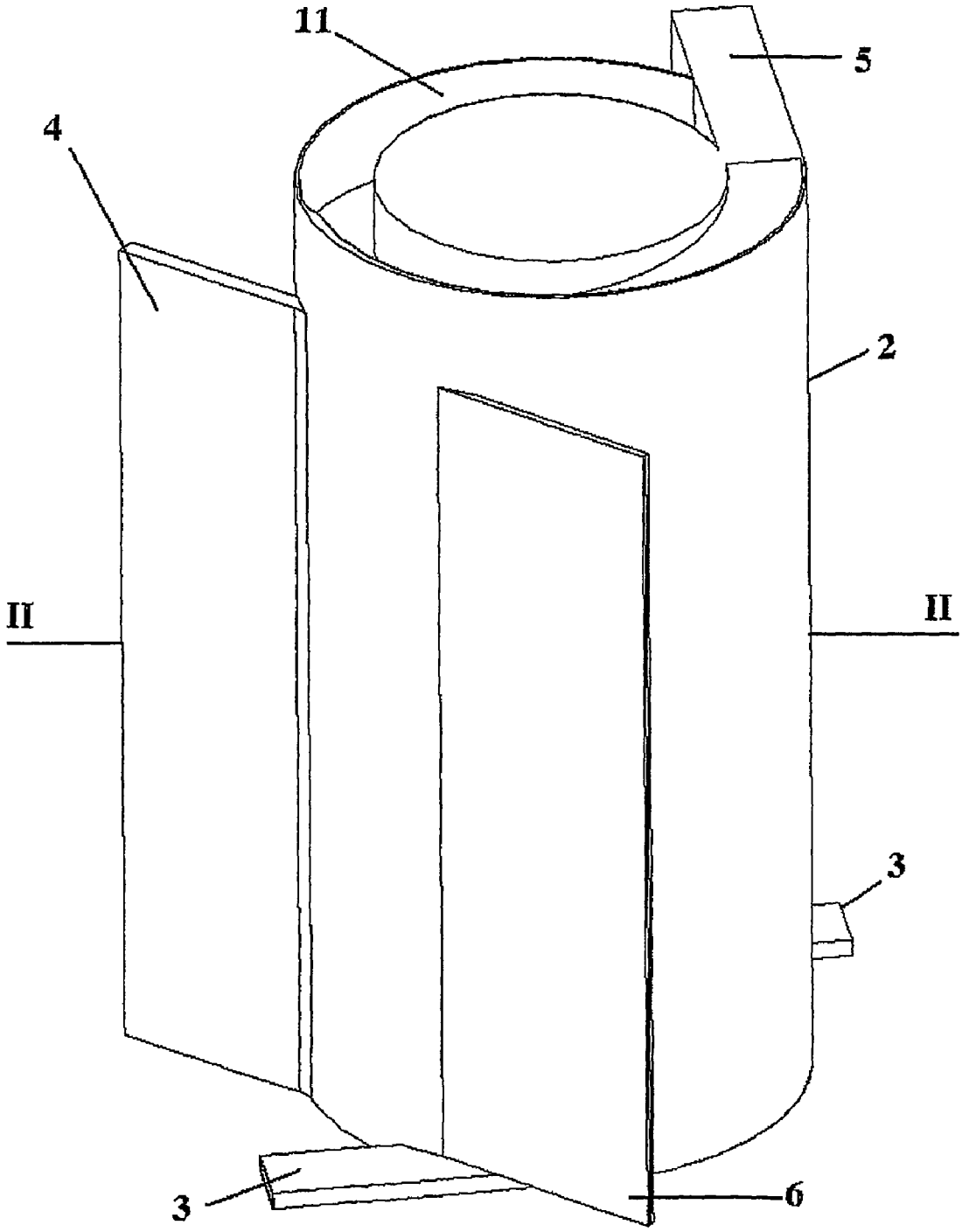
FIG. 1 shows a perspective view of a first specific embodiment of the apparatus according to the invention.

The apparatus represented in FIG. 1 comprises a centrifugation chamber 11, delimited by a vertical cylindrical side wall 2.

Figure 2:
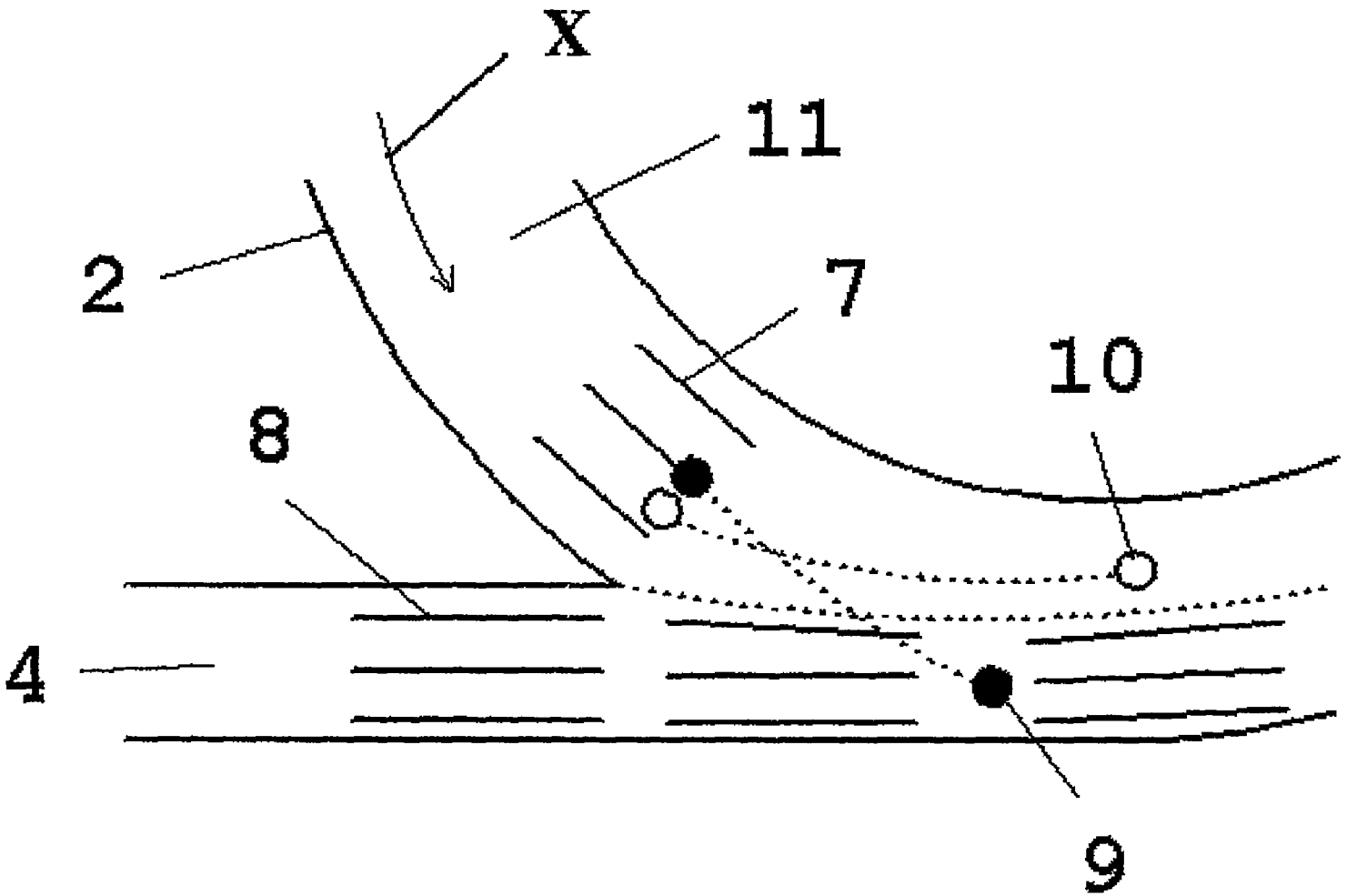
FIG. 2 shows schematically a detail of the apparatus of FIG. 1, in transverse cross section along the plane II-II of FIG. 1.

Two ducts 3 open into the bottom of the chamber 11, tangentially to the cylindrical wall 2, at the two ends of a same diameter. The ducts 3 serve to introduce a slurry of particulate matter into the chamber 11 so as to subject it therein to a rotation in the direction of the arrow X (FIG. 2).

The chamber 11 is in communication with a narrow vertical duct 4, which passes through the wall 2 over approximately its entire height, and the orientation of which is approximately tangential relative to said wall. The duct 4 is oriented so as to introduce a fluid in the direction of the arrow X into the chamber 11. The function of the duct 4 will be explained below.

The chamber 11 is also in communication with a duct 5 close to its upper end and with a duct 6 in an intermediate zone. These two ducts serve to draw off fractions of the slurry treated in the chamber 11.

The ducts 3, 4, 5 and 6 are oriented in such a way as to open into the chamber 11, tangentially relative to its wall 2.

The apparatus of FIG. 1 is intended for implementing the method according to the invention. To this effect, a particulate matter in the form of ultrafine particles is dispersed in water so as to form a slurry. The slurry is introduced into the ducts 3 with a speed that is uniform over time and controlled so as to subject said slurry to rotary circulation in the chamber 11. Moreover, pressurized water is injected into the layer of slurry in the chamber 11, via the duct 4. The injection of the water is continuous and at a substantially constant flow rate, thereby causing pulses in the slurry, opposite the duct 4. Under the action of these pulses, the particles of the particulate matter are subjected to isolated tangential and centripetal accelerations when they pass opposite the duct 4, in the chamber 11. These isolated centripetal accelerations superimpose on the continuous and substantially constant centrifugal acceleration. The magnitude of the centripetal accelerations is determined through an appropriate choice of the flow rate, of the pressure and of the speed of the water injected in the duct 4. FIG. 2 shows schematically the combined action of the continuous centrifugal acceleration and of the isolated centripetal accelerations. In this figure, the lines 7 show schematically the lines of circular stream of the slurry subjected to the centrifugation in the chamber 11 and the lines 8 show schematically the lines of stream of the water introduced into the chamber 11 via the duct 4. Under the combined effect of the continuous centrifugal acceleration and of the isolated centripetal accelerations, radial classification of the particles of solid matter takes place in the chamber 11, according to their respective densities: the most dense particles (9) migrate to the periphery of the chamber (11), whereas the light particles (10) migrate to the center of the chamber. The dense particles are drawn off with liquid from the slurry, via the duct 6, and the light particles are drawn off with liquid from the slurry, via the duct 5. In the case where the useful substance of the particulate matter is more dense than the unproductive substances of the particulate matter, the fraction of slurry drawn off from the chamber 11 via the duct 6 is the useful fraction, enriched in useful substance, while the fraction drawn off via the duct 5 contains mostly unproductive substances.

In the apparatus of FIGS. 1 and 2, the duct 4 should be oriented in such a way that the flow of water which enters the chamber 11 has a radial component.

FIGS. 3, 4, 5 and 6 show various arrangements of the duct 4, which produce this technical function.

Figure 3:
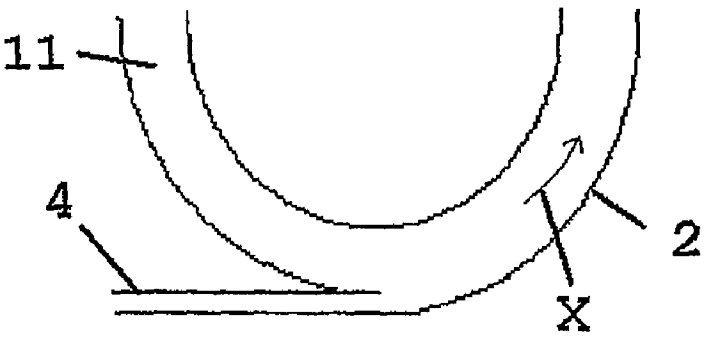

In the arrangement of FIG. 3, the duct 4 enters the chamber 11 tangentially to its peripheral wall 2. The chamber widens downstream of the duct 4.

Figure 4:
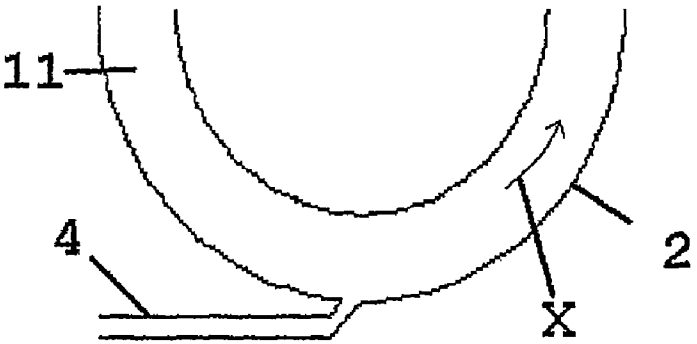
FIGS. 3, 4, 5 and 6 are schemes similar to that of FIG. 2, of four variations of the detail of FIG. 2.
Figure 5:
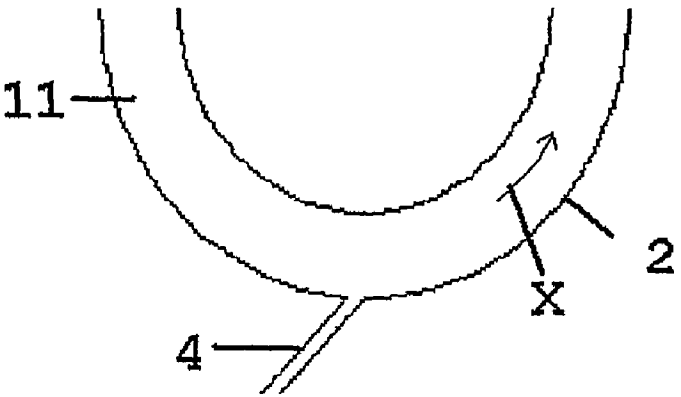

In the arrangements of FIGS. 4 and 5, the duct 4 enters the cylindrical chamber 11 obliquely and the diameter of said chamber is uniform.

Figure 6:
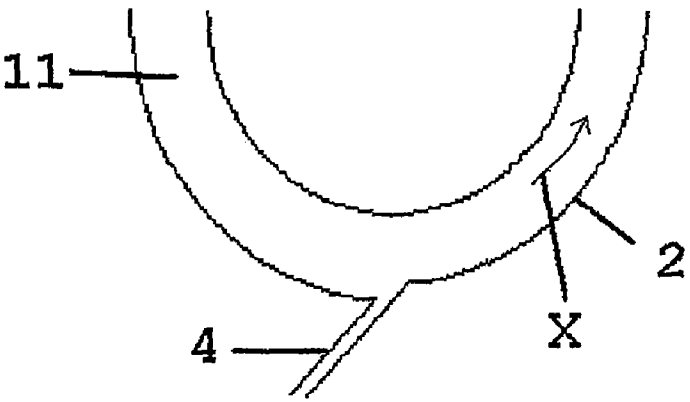

In the arrangement of FIG. 6, the duct 4 enters the chamber 11 obliquely and said chamber narrows downstream of the duct 4.

Figure 7:
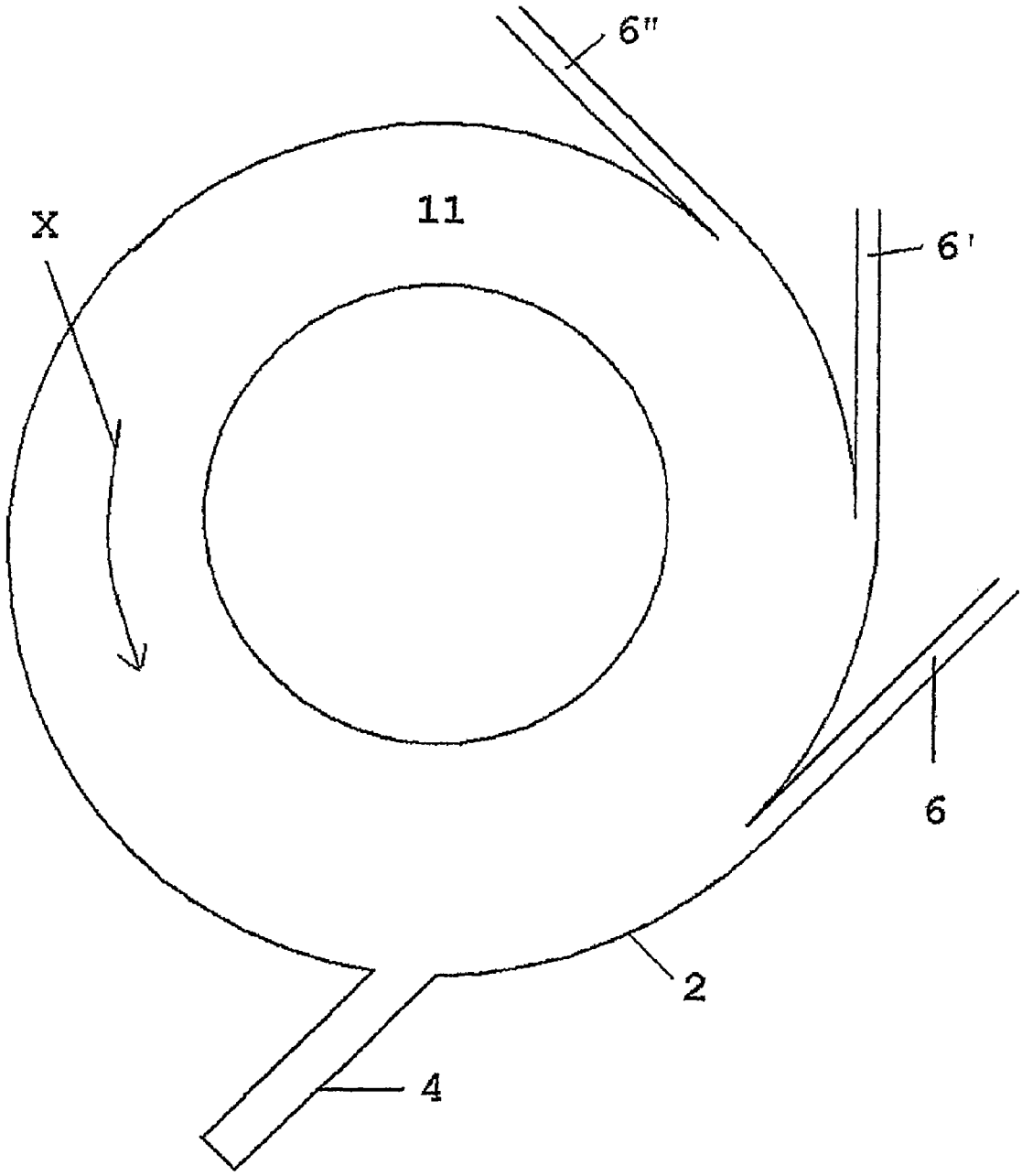
FIG. 7 is a scheme similar to that of FIG. 2, of an additional variation of the detail of FIG. 2.

In the apparatus shown schematically in FIG. 7, several ducts 6, 6', 6" open into the chamber 11, through its wall 2. The ducts 6, 6', 6" are angularly offset. They serve to draw off fractions of the slurry which differ by virtue of the density of the solid substances that they contain. Given the direction of rotation X of the slurry in the chamber 11, the density of the fractions drawn off decreases from the duct 6 (which is closest to the duct for introducing water 4) to the duct 6" (which is the furthest away from the duct 4). This embodiment of the invention makes it possible to divide the particulate matter up into several fractions having different concentrations of useful substance. The fractions can be recovered separately. As a variation, the lightest fraction 6" (or each fraction 6' and 6") can be recycled such as into the introduction ducts 3.

Figure 8:
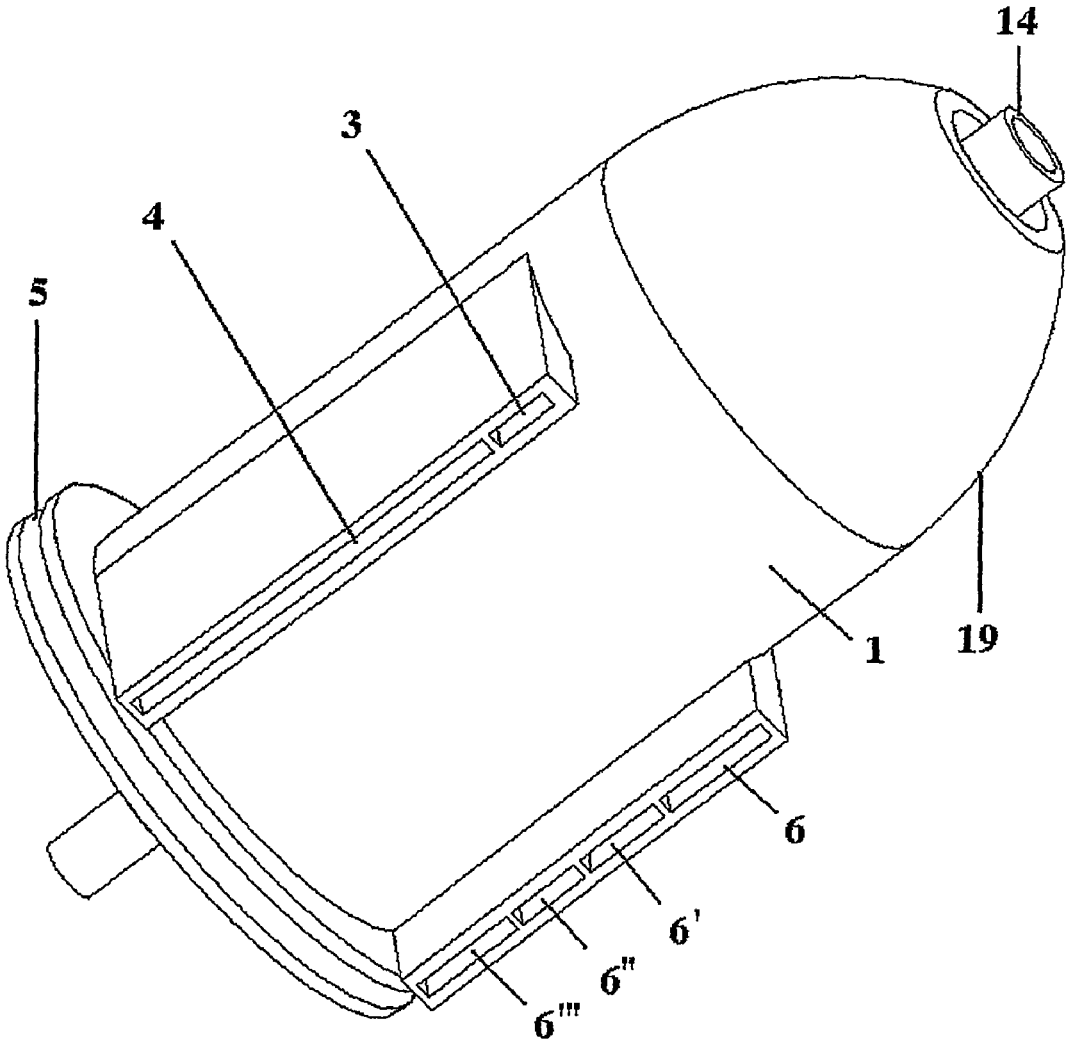
FIG. 8 shows a perspective view of another embodiment of the apparatus according to the invention.
Figure 9:
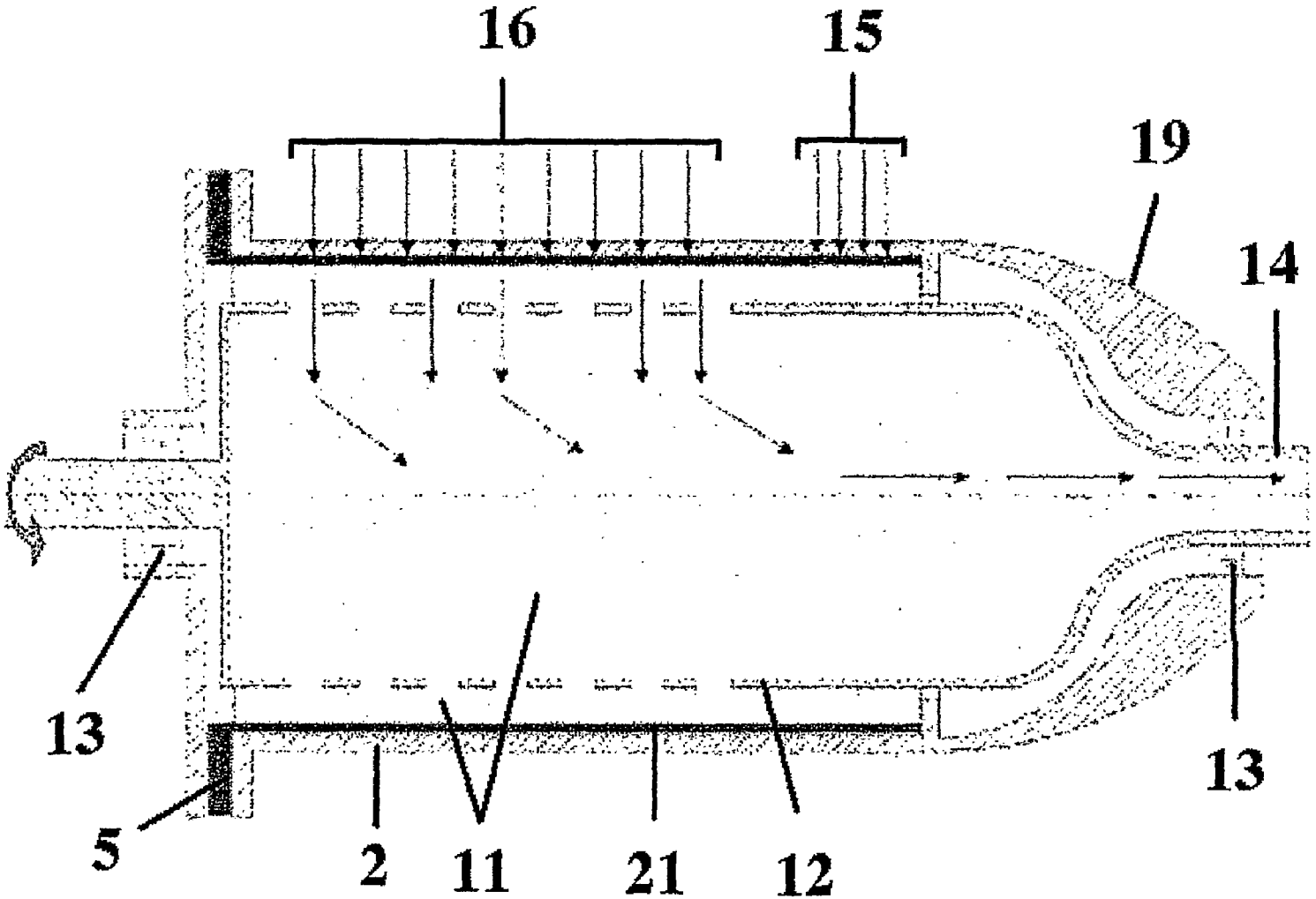
FIG. 9 shows the apparatus of FIG. 8 in axial section.

In the apparatus represented in FIGS. 8 and 9, the cylindrical chamber 11 contains a cylinder 12 with an apertured wall (FIG. 9), the axis of which coincides with that of the chamber 11. The cylinder 12 is mounted on bearings 13, in such a way as to be able to rotate freely in the chamber 11, so as to reduce the head losses in the rotating slurry. As a variation, the cylinder 12 can be driven by an electric motor (not represented). The cylinder 12 is extended by a throat 14 which opens to the outside, after having passed through a corresponding throat 19 of the chamber 11.

During the operating of the apparatus of FIGS. 8 and 9, the slurry 15 is introduced into the chamber 11 via the duct 3, in such a way that it undergoes a centrifugation into said chamber 11. The slurry splits into a layer 21 against the wall 2 of the chamber 11. Water 16 is continuously injected (FIG. 9), via the duct 4 (FIG. 8), into the layer of slurry. The water which has passed through the layer of slurry passes through the apertured wall of the cylinder 12 and is evacuated from the apparatus via the throat 14. The light fraction 17 of slurry is recovered via the annular aperture 5 located downstream of the apparatus, the dense fraction is recovered via the aperture 6 and fractions of intermediate densities are drawn off via apertures 6', 6" and 6'" located between the aperture 6 and the aperture 5.

Figure 10:
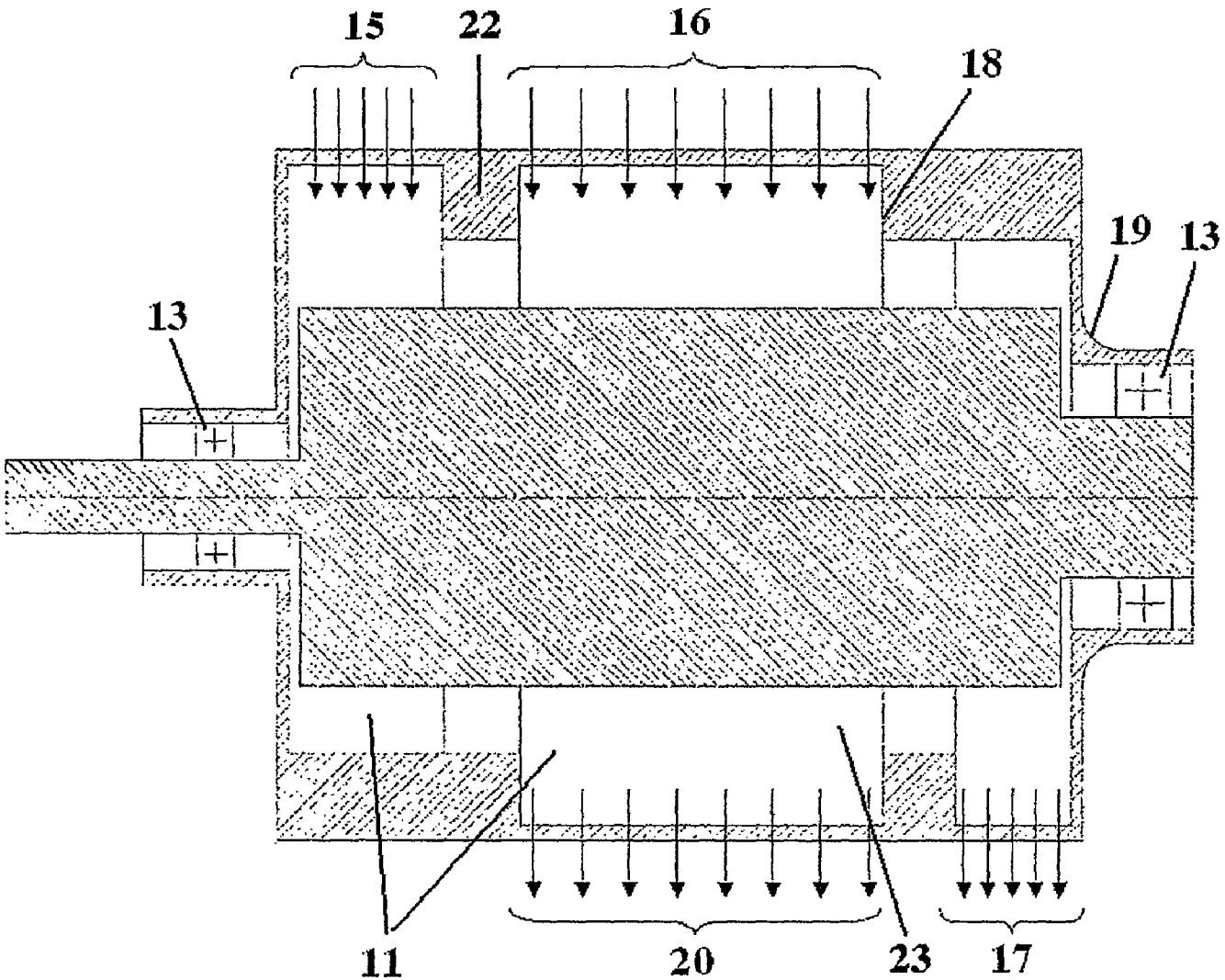
FIG. 10 shows an additional embodiment of the apparatus according to the invention, in axial section.

The apparatus shown schematically in FIG. 10 differs from the apparatus of FIGS. 8 and 9 by virtue of the presence of two annular thresholds 18 and 22 on the wall 2, in the chamber 11. The two thresholds 18 and 22 are placed between the duct 3 (not visible) for introducing the slurry 15 and the duct 5 (not visible) for evacuating the light fraction 17. They together form an annular cavity 23, into which the duct 4 (not represented, serving to inject the water 16 for the pulses) and the duct 6 (not represented, serving to evacuate the dense fraction 20) open.

During the operating of the apparatus of FIG. 10, the dense fraction 12 of the slurry is drawn off from the annular cavity 23 and the light fraction 17 runs over the threshold 18. All things being otherwise equal, the apparatus of FIG. 10 produces a more precise cutoff between the light particles and the dense particles of the slurry.

Figure 11:
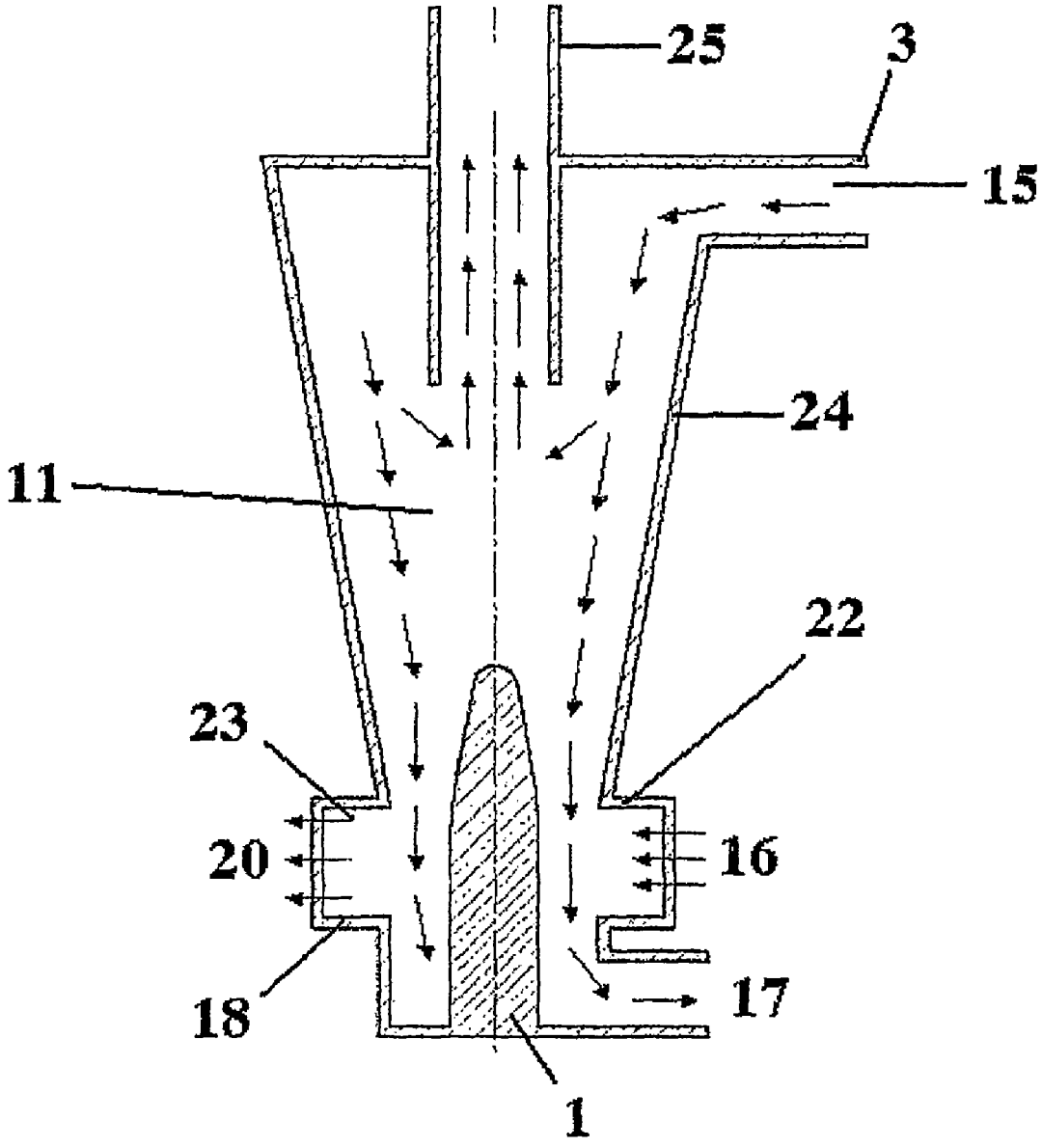
FIG. 11 shows a modified embodiment of the apparatus of FIG. 10, in axial section.

In the apparatus of FIG. 11, the chamber 11 comprises a hydrocyclone 24 upstream of the threshold 22. The duct 3 for introducing the slurry 15 opens into the hydrocyclone 24. During the operating of the apparatus, the slurry passes through the hydrocyclone 24 and migrates to the annular cavity 23. The cyclone 24 serves to separate the particles which are too fine from the particulate matter, these particles being evacuated via the axial shaft 25.

The invention claimed is:

1. A method for concentrating by densimetry a particulate matter, comprising at least two constituents of different densities, in which a slurry of said particulate matter is subjected to jigging by centrifugation and to centripetal pulses in a centrifugation chamber having a length and a stationary and substantially cylindrical peripheral wall, and a dense fraction of the slurry and a light fraction of the slurry are drawn off from the centrifugation chamber through the peripheral wall of the chamber, wherein, in order to produce the centripetal pulses, a fluid is injected into the slurry through the peripheral wall of the chamber in a direction oblique or tangential to the peripheral wall such that a pulsing force is imparted to the slurry in the direction of centrifugation, the fluid being injected substantially continuously into the slurry.

2. The method as claimed in claim 1 wherein the slurry is introduced into the chamber nearly tangentially to the peripheral wall of said chamber.

3. The method as claimed in claim 1, wherein at least one additional drawing off of an additional fraction of slurry is carried out, downstream of the drawing off of the dense fraction with respect to the direction of rotation of the slurry and upstream of the drawing off of the light fraction with respect to the direction of rotation of the slurry.

4. The method as claimed in claim 1, wherein the fluid is injected through the abovementioned peripheral wall, substantially over the entire length of the chamber.

5. The method as claimed in claim 1, wherein the abovementioned direction of injection of the fluid into the slurry has a radial component.

6. The method as claimed in claim 4, wherein the abovementioned direction of injection of the fluid into the slurry has a radial component.

7. The method as claimed in claim 1, wherein the fluid is the liquid of the slurry.

8. The method as claimed in claim 4, wherein the fluid is the liquid of the slurry.

9. The method as claimed in claim 1, wherein the fluid comprises water.

10. The method as claimed in claim 8, wherein the fluid comprises water.

11. The method as claimed in claim 1, wherein centrifugation is adjusted so as to subject the slurry to a centrifugal acceleration of greater than 3000 $m/s^2$, and the flow rate of the continuous injection of the fluid is adjusted such that the centripetal pulses have an acceleration substantially between 1 and 5 times the abovementioned centrifugal acceleration.

12. The method as claimed in claim 10, wherein centrifugation is adjusted so as to subject the slurry to a centrifugal acceleration of greater than 3000 $m/s^2$, and the flow rate of the continuous injection of the fluid is adjusted such that the centripetal pulses have an acceleration substantially between 1 and 5 times the abovementioned centrifugal acceleration.

13. The method as claimed in claim 1, wherein the particulate matter is in the form of particles, the diameter of which is substantially between 1 and 500 μm.

14. The method as claimed in claim 12, wherein the particulate matter is in the form of particles, the diameter of which is substantially between 1 and 500 μm.

15. The method as claimed in claim 1, wherein the particulate matter comprises an ore.

16. The method as claimed in claim 14, wherein the particulate matter comprises an ore.

17. An apparatus for concentrating a particulate matter, comprising at least two constituents of different densities, said apparatus comprising a centrifugation chamber provided with a stationary and substantially cylindrical peripheral wall extending along a length, a device for introducing a slurry of said particulate matter into the centrifugation chamber, a device for generating centripetal pulses in the slurry in the centrifugation chamber, a device for drawing off a dense fraction of the slurry and a device for drawing off a light fraction of the slurry, wherein the device for drawing off a dense fraction of the slurry and the device for drawing off a light fraction are arranged in the peripheral wall to draw off liquid through the peripheral wall, and the device for generating centripetal pulses in the slurry comprises a duct which opens into the centrifugation chamber through the peripheral wall in a direction oblique or tangential to the peripheral wall, and which communicates with a pressure source, said pressure source being designed such that the injection of the fluid is continuous and at a substantially constant flow rate and/or speed, and the duct for injection of impulse generating fluid is arranged downstream of the duct for introducing the slurry and upstream of the device for drawing off a dense fraction and the device for drawing off a light fraction, with respect to the direction of flow.

18. The apparatus as claimed in claim 17, wherein the device for introducing the slurry comprises a duct which opens into the abovementioned chamber, tangentially to the peripheral wall and which communicates with a member for continuous injection of the slurry.

19. The apparatus as claimed in claim 17, wherein the duct which communicates with the pressure source extends over substantially the entire length of the peripheral wall of the chamber, downstream of the duct for introducing the slurry with respect to the direction of the flow.

20. The apparatus as claimed in claim 17, wherein the peripheral wall of the centrifugation chamber is cylindrical.

21. The apparatus as claimed in claim 18, wherein the peripheral wall of the centrifugation chamber is cylindrical.

22. The apparatus as claimed in claim 17, wherein the peripheral wall of the chamber comprises two annular thresholds between the duct for introducing the slurry and the duct for drawing off the light fraction, the two thresholds together defining an annular cavity into which, respectively, the duct for introducing the fluid and the duct for drawing off the dense fraction open.

23. The apparatus as claimed in claim 17, wherein the centrifugation chamber comprises a hydrocyclone into which the duct for introducing the slurry opens.

24. The apparatus as claimed in claim 18, wherein the centrifugation chamber comprises a hydrocyclone into which the duct for introducing the slurry opens.

* * * * *